United States Patent [19]

Grosvernier

[11] 4,339,044

[45] Jul. 13, 1982

[54] INSTALLATION FOR INSPECTING AND SORTING PRINTED SHEETS OF PAPER

[75] Inventor: Claude Grosvernier, Hauterive, Switzerland

[73] Assignee: Compagnie Industrielle Radioelectrique, Switzerland

[21] Appl. No.: 149,563

[22] Filed: May 14, 1980

[30] Foreign Application Priority Data

May 31, 1979 [CH] Switzerland ..... 5066/79

[51] Int. Cl.³ ..... B07C 5/00

[52] U.S. Cl. ..... 209/564; 209/552; 209/555

[58] Field of Search ..... 209/552, 563, 564, 565, 209/566, 569, 583, 555

[56] References Cited

U.S. PATENT DOCUMENTS 3,032,191 5/1962 Clukey ..... 209/564 X 3,289,832 12/1966 Ramsay ..... 209/566

3,993,193 11/1976 Welch et al. ..... 209/583 X

*Primary Examiner*—Joseph J. Rolla

*Attorney, Agent, or Firm*—Robert E. Burns; Emmanuel J. Lobato; Bruce L. Adams

[57] ABSTRACT

The installation comprises several inspecting devices disposed along a track and controlling a switch. Each inspecting device is followed by a device for detecting the passage of the sheets, associated with a cyclic counter assigning a consecutive number to each sheet. A logic circuit directs the information from the inspection devices to reference memories the number of which is equal to the number of possible content conditions of the counters, (i.e. consecutive numbers) the information being directed to the reference memory whereof the number corresponds to the consecutive number of the sheet as assigned by the counters. Since the sheets are assigned numbers during their passage through the inspection region, it is possible to have several sheets simultaneously in this region.

3 Claims, 6 Drawing Figures

INSTALLATION FOR INSPECTING AND SORTING PRINTED SHEETS OF PAPER

The present invention relates to an installation for inspecting and sorting printed sheets of paper, in particular bank notes before they are put into circulation, the installation comprising a linear transfer path along which are disposed several inspection devices for inspecting the sheets according to different criteria, such as margins, printing, and fluorescence. A switch located at the end of the transfer path is controlled by the inspecting devices for sorting the sheets into "accepted" sheets and "rejected" sheets.

It is known to inspect and sort documents into acceptable and unacceptable by means of a detector controlling a switch. When it is a question of inspecting a printed sheet of paper according to several criteria, a switch has been placed hitherto after each detector. This requires several switches each with their own control circuit and several stores for receiving the rejected sheets. Such an installation is relatively long, bulky and expensive. Furthermore, it is necessary to take into account the reaction time of each of the switches, which limits the speed of travel of the sheets or requires an extension of the path. If only one switch is provided at the end of the inspection region, it is necessary to wait until the sheet inspected has passed the switch before dispatching the following sheet.

U.S. Pat. No. 3,432,035 has already proposed following the progress of a document in a reading and sorting installation in order to make it possible to introduce several documents into the installation quickly and in succession, so that several documents are located simultaneously in the installation, between the reader and the switch or switches. To this end, it has been proposed to use a counter/subtractor at the inlet of the inspection path, which counts one unit as a document enters the inspection path and subtracts a unit as a document leaves the inspection path. This counter/subtractor is associated with a memory in which, by means of a logic circuit, selection signals are memorised in numbered compartments to which the detection signals are sent by the counter/subtractor. Furthermore, subtraction controls corresponding switches by means of a logic arrangement receiving the memorised information, in order to direct the document sorted to the corresponding switch. However, if the documents enter at a regular rhythym, which is the case if they are removed one by one from a stack for example, for each incoming document counted, a departing document is subtracted, so that the content of the counter/subtractor remains virtually unaltered and can do no more than indicate the general progression of the documents.

An object of the present invention is to provide a valid solution for the problem of pursuing several documents located simultaneously in the inspection region of an installation of the aforementioned type, in order to make it possible to increase the speed of inspection using only one switch in an installation which is as short as possible.

According to the present invention, there is provided an installation for inspecting and sorting printed sheets of paper, comprising a linear transfer path along which are disposed a plurality of devices for inspecting the sheets according to different criteria, and a switch at the end of the transfer path, controlled by the inspecting devices, for sorting the sheets into "accepted" sheets and "rejected" sheets, wherein the installation comprises, associated with each inspection device, a device for detecting the passage of the sheets and a cyclic counter for assigning a consecutive number to each sheet detected, a reference memory in respect of each possible content condition of the counters, transfer memories between each of the inspection devices and the reference memories, a logic circuit between the counters and the reference memories for directing information from the inspection devices to the reference memory which corresponds to the number assigned to a sheet by the counters, and means for determining the position of the switch from the memorised signals.

The sheets are effectively provided with a label corresponding to the consecutive number which is attributed thereto for their passage into the inspection region. The number of consecutive numbers, i.e. the number of sheets able to be located simultaneously in the inspection region, is theoretically unlimited. Nor does the system impose any limit to the number of inspection devices between two detectors for the passage of sheets. Furthermore, the optical information obtained by the devices for detecting the passage of sheets may be used to check the correct passage of the sheets, by subtracting pulses in synchronism with the advance of the sheets.

The accompanying drawings illustrate one embodiment of the invention by way of example.

Figure 1:
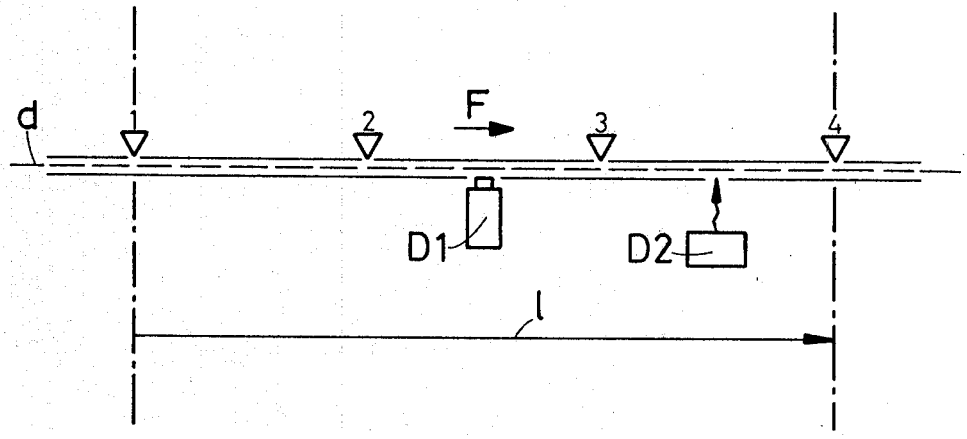
FIG. 1 is a partial block diagram of an installation according to the invention.
Figure 2:
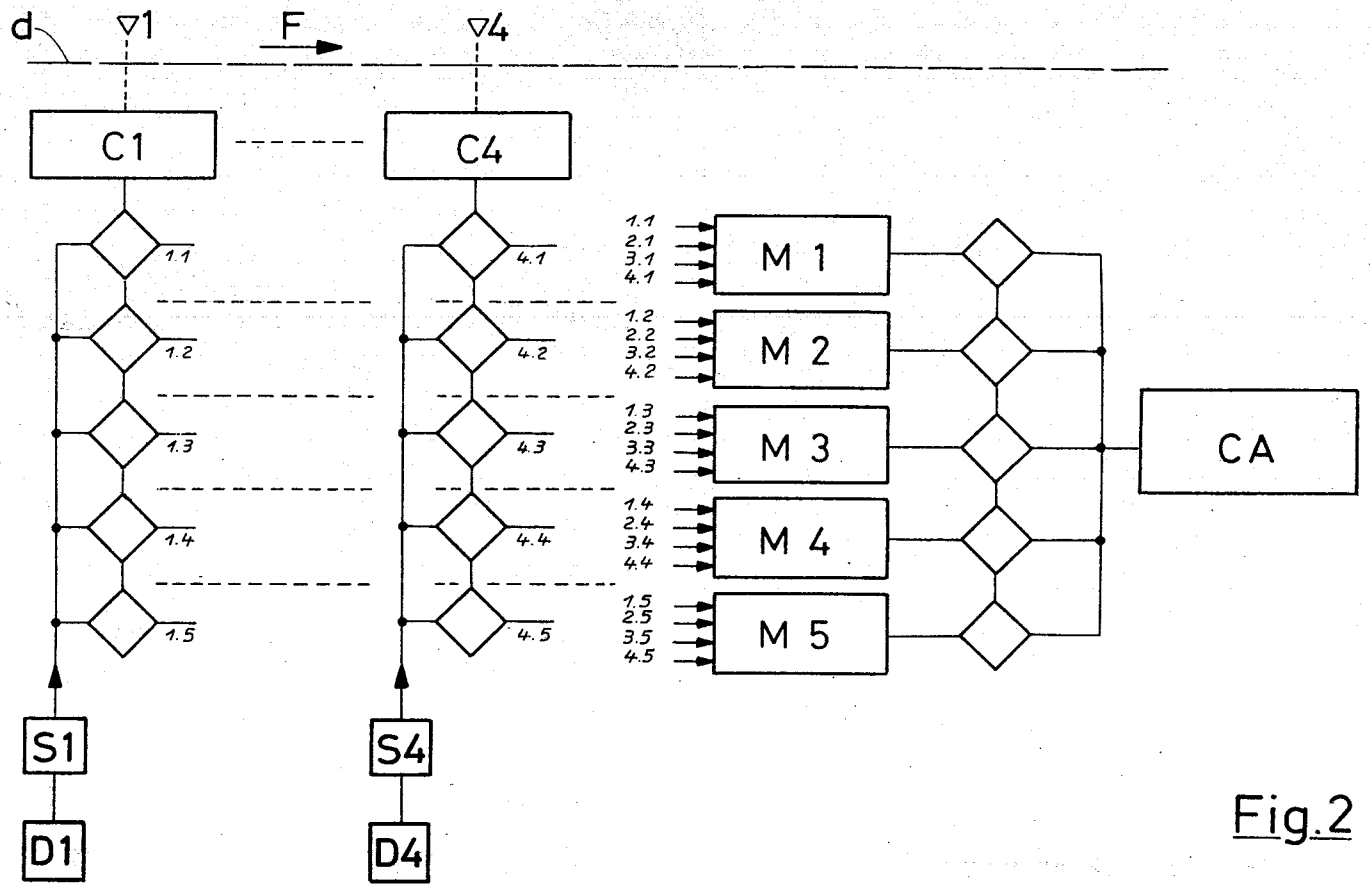
FIG. 2 shows a simplified logic diagram of means for numbering the sheets and memorising the quality of the sheets.

Referring to FIG. 1, a transfer path is illustrated diagrammatically by the broken line d. This transfer path is constituted for example by a belt. Located along the length l of the transfer path are four cells ∇1 to ∇4 for checking the passage of the notes. Located between the cells are a number of inspection devices such as D1 and D2. Associated with each of these cells ∇1 and ∇4 is a counter C1 to C4 respectively (FIG. 2). Each of these counters is incremented by the pulses received from the cell associated therewith for each passage of a sheet moving in the direction of arrow F. Counting takes place cyclically, i.e. when the counter is full, it recommences counting from 1. In the example in question, each counter counts cyclically from 1 to 5. Thus each time a sheet passes in front of a checking cell, the corresponding counter passes into a state corresponding to a consecutive number or virtual label attributed to the sheet. The first sheet arriving in the inspection region thus causes the counters C1 to C4 to pass in succession from position 0 to position 1. This sheet thus receives the number 1. The second sheet causes each counter to pass in succession to position 2 and thus receives the number 2 and so on. It is thus possible to have 5 sheets simultaneously in the inspection region distinguished by their number. Located before each checking cell ∇1 to ∇4 is at least one detector D1 to D4 inspecting one feature of the printed paper such as width of the margins, fluorescence etc. Each of the five outputs of the counters makes it possible to distinguish which sheet of the 5 numbered sheets should be attributed to the signal detected by each of the detectors D1 to D4 in order to determine if the sheet should be rejected (yes) or accepted.

The counters C1 to C4 are associated with five memories M1 to M5 intended to memorise the reject instruction given by one or more detectors, whilst waiting until the sheet to be rejected reaches the position of a rejector switch. The memory M1 is assigned to sheet number 1, memory M2 to sheet number 2 and so on. Thus, each memory receives the reject instruction from the corresponding decision stage illustrated by a diamond under each counter. The for the counter C1, the output 1.1 is connected to the corresponding input 1.1 of the memory M1, the output 1.2 is connected to the corresponding input 1.2 of the memory M2 and so on. At the end of the measuring region, when a sheet passes below the cell ∇ 4, the memory whose number corresponds to the number of the sheet indicates if the sheet should be rejected or not. The rejection instruction is transmitted to a delayed switching control CA. Thus, between the cells ∇ 1 to ∇ 4, the detectors D1 to D4 decide on the quality of the sheet, but the transfer of information, relating to whether the sheet is acceptable or unacceptable, takes place solely below the cell immediately following the detector. Since it is only possible for the beginning of two sheets to be engaged between two cells, numbering of the sheets in pairs makes it possible to collect information of intermediate quality, which information is transferred to the memory corresponding to the number of the sheet when the latter passes below the cell. Since the information read by the detector is not transmitted immediately, it is necessary to retain the latter. This is simply achieved by means of a respective shift register S1 to S4. The system imposes no limits to the number of detectors D between the cells ∇ 1 to ∇ 4.

Figure 3:
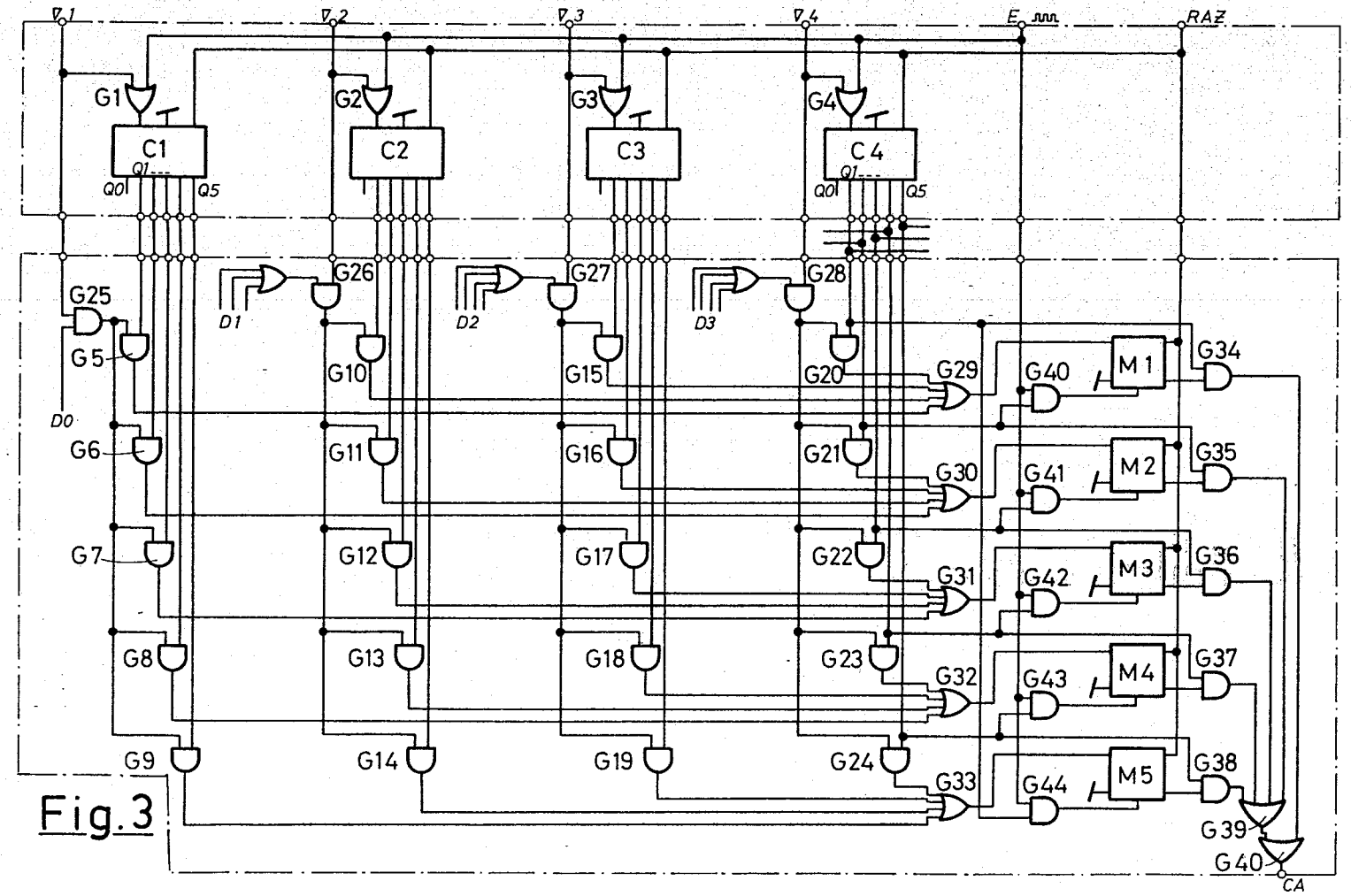
FIG. 3 shows the logic diagram of means for checking the transfer of sheets.

A simplified logic wiring diagram corresponding to the diagram of FIG. 2 is illustrated in FIG. 3. The counters C1 to C4 are of the MC 14017 type. These counters count step by step under the combined effect of pulses coming from the cells ∇ 1 to ∇ 4 and clock pulses E applied through OR gates G1 to G4 assigned to each counter. The counters may be reset to zero by means of a RTZ signal. The outputs Q1 to Q5 of the counter C1 are applied respectively to an AND gate G5, G6, G7, G8 and G9, to which there is also applied a signal coming from a detector D0, the signal coming from the detector D0 indicating the simultaneous presence of two sheets or other faults. However, the signal D0 is applied to the gates G5 to G9 solely upon the arrival of a signal from the cell ∇ 1, i.e. when the sheet, respectively the two sheets, pass in front of the cell ∇ 1, the coincidence being checked by an AND gate G25 to which the two signals are applied. The output of the gate G25 is connected to the five AND gates G5 to G9. Similarly, the outputs of the counters C2 to C4 are connected respectively to AND gates G10 to G24. The signals emanating from a detector D1 are applied to an AND gate G26 with the signal from the cell 2, the output of the gate G26 being applied to the five gates G10 to G14. The same is true for a detector D2 through an AND gate G27 and a detector G3 through an AND gate G28. The outputs of the AND gates G5, G10, G15, G20 are applied through an OR gate G29 to the first memory M1 corresponding to sheet number 1. In an identical manner, the outputs G6 to G21 are applied through an OR gate G30 to the memory M2, the outputs of the gates G7, G12, G17, G22 are applied through an OR gate G31 to the memory M3 etc. The memories M1 to M5 are constituted by simple bistable triggers which are reset to zero by the RTZ signal. The outputs Q1 to Q5 of the last conter C4 are also connected respectively to AND gates G34 to G38. Finally, the output signals of the gates G34 to G38 are applied to switching control circuits CA through two OR gates G39 and G40.

Thus, for example, if the detector D1 indicates a fault on sheet number 3, the signal emanating from D1 passes through the gate G26 when the sheet passes the cell ∇ 2. At this instant, the counter C2 sends a signal by its output Q3 to the gate G12, so that the signal emanating from D1 is applied to the trigger M3 which memorises this signal.

The output Q of the trigger M3 thus passes to the state 1 and when the faulty sheet arrives in front of the cell ∇ 4, the counter C4 opens the gate G36 by its output Q3 corresponding to sheet number 3. The coincidence of two signals at gate G36 results in the generation of a switching control signal. The clock signal E is also applied to the triggers M1 to M5 through AND gates G40 to G44 to which are respectively applied the outputs Q2, Q3, Q4, Q5 and Q1 of the last counter C4 in order to ensure that the triggers M1 to M5 are reset to zero, i.e. cancellation of the memory M1 upon the arrival of sheet number 2 in front of the cell ∇ 4. For example, if M1 has registered a fault before controlling the switch, it is reset to zero, i.e. cancelled, when the output Q2 of the counter C4 is activated and coincides with a clock pulse E, the coincidence of these two signals being controlled by the gate G40.

Figure 5:
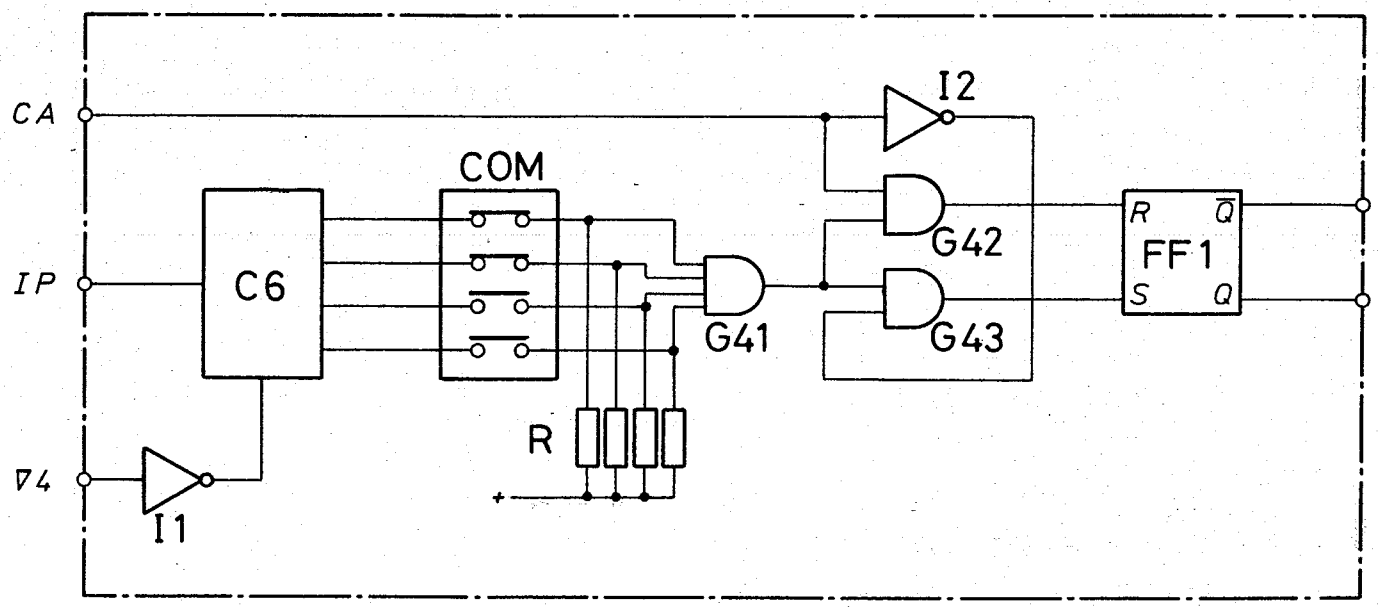
FIG. 5 shows a simplified logic diagram of means for controlling the switch.

The rejector switch which is not shown is mechanically connected to two electro-magnetic circuits. One circuit serves for the opening of the switch, the other for its closure. Upon each change of position, a high value current passes through the coil of an electro-magnetic circuit and when the change of position has taken place, a low value current keeps the switch in its new position. The switch is located at a short distance after the end of the inspection region. From the end of this region, the order to change the position of the switch is delayed in order to allow the travel of the preceding sheet into the switch. This delay is obtained by means of the circuit illustrated diagrammatically in FIG. 5. The control signal emanating from the gate G40 of FIG. 3 is designated by CA. This signal CA is applied on the one hand to an AND gate G42 and on the other hand through a reversing switch I2 to a second AND gate G43. The outputs of the two gates G42, G43 are applied respectively to each of the inputs of a flip-flop FF1. The delay is introduced by counting a certain number of pulses when the sheet passes below the last cell ∇ 4, pulses whose frequency is proportional to the forward movement of the belts for transferring the sheets. These proportional pulses IP, for example 3.3 mm per pulse, are applied to a counter C6, whereof the reset-to-zero terminal receives the signal coming from the cell ∇ 4, through a reversing switch I1. The outputs of the counter C6 are applied to a manual pre-selection circuit-breaker COM, of the DUNCAN type, associated with an AND gate G41 whereof the output is applied to the two AND gates G42, G43. Through interfaces which are not shown, the outputs Q and $\overline{Q}$ of the trigger FF1 control each of the electro-magnetic circuits of the switch. Starting from each pulse received from the cell ∇4, the counter C6 counts a certain number of pulses IP. When the four outputs of the circuit-breaker COM are activated, the gate G41 passes to state 1. If, at this instant, a pulse CA is present, the input R of the trigger FF1 is activated through gate G42. On the other hand, if the signal CA is 0, it is this inverted signal which will coincide with the signal emanating from G41, at gate G43, keeping the input S of the trigger FF1 actuated.

The state of the trigger FF1 is thus clearly determined by the signal CA with a delay introduced by the counter C6 from the time of passage of the sheet in front of the last cell ∇4.

The progress of the sheets must be monitored in order to eliminate damage to a large number of sheets if one should be jammed in the installation. This inspection takes place from cell to cell and two main signals are used for this purpose. For example, the arrival of a sheet below a cell ∇n is monitored and an electronic circuit is charged and then discharged in proportion to the forwards movement of the sheet in the direction of cell ∇n+1. At the end of the calculation, an end of calculation pulse appears, which constitutes an indication of the "theoretical presence" of the sheet. The cell ∇n+1 which observes the sheet sends a beginning of the sheet signal corresponding to the "physical presence" of the sheet. Any tolerance in the progress of the sheet is determined by selecting the duration of this second signal. If the first signal occurs within the time interval defined by the presence of the second signal, progress is recognised as normal; if not, the installation receives an "urgent stop" command.

Since it is possible for the leading edges of two sheets to be engaged between two cells, two calculating devices operate independently and supply pulses relating to the theoretical presence of bank notes. The circuit used to carry out this inspection is illustrated diagrammatically in FIG. 4. This circuit comprises six counters/subtractors C8 to C13 which can be programmed manually by means of preselection circuit-breakers of the DUNCAN type DU1 and and DU2 making it possible to pre-select the calculation according to the distance between two successive cells. Since two sheets may be located simultaneously between two cells, the counters/subtractors are divided into two identical groups C8, C9, C10 and C11, C12, C13. The signal ∇3 coming from the cell ∇3 is applied through an AND gate G46, a trigger F2 and two AND gates G47 and G48 to the counters C8 to C13 in order to charge these counters. Calculation is ensured by means of pulses IP2, the period of which is proportional to the forward movement of the sheets. The end of the calculation causes the appearance of a signal at the OR gate G49, which is applied to the terminal C of a flip-flop F7. This signal corresponds to the theoretical presence of the sheet in front of the following cell, i.e. the cell ∇4 in this example.

Figure 6:
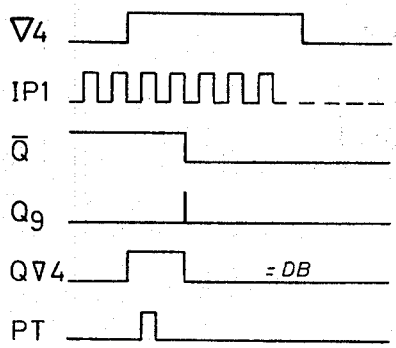
FIG. 6 shows the waveforms of signals appearing in the installation.

The theoretical presence of the sheet should coincide with its actual presence in front of the cell ∇4. However, the signal ∇4 is a very long signal, since it corresponds to the time of passage of the sheet in front of the cell. Detection of the coincidence of the "theoretical presence" signal with this long signal would not provide sufficiently accurate inspection. In order to increase the accuracy and to be able to fix the tolerance of the inspection as desired, a signal Q∇4 (FIG. 6) is formed by means of the signal ∇4, this signal Q∇4, of arbitrary length, corresponding to the beginning of the passage of the sheet in front of the cell ∇4, which signal will hereafter be referred to as the beginning of the sheet signal DB. This signal is formed by means of a counter C14, of a flip-flop F6 and of an AND gate G44. The signal ∇4 is applied simultaneously to the AND gate G44 and to another AND gate G45 as well as to a reversing switch 12. Also applied to the gate G44 is a signal IP1 constituted by an uninterrupted succession of pulses whereof the frequency is proportional to the forward movement of the sheets. The output signal of the gate G44 is applied to the counter C14, whereof the output Q9 is applied to the input S of the flip-flop F6. The diagram of these pulses is illustrated in FIG. 6. The end of the signal ∇4 is used to reset the counter C14 to zero through the reversing switch 12.

The coincidence of the signals DB corresponding to the actual presence of the sheet in front of ∇4 and of the signal PT emanating from the gate G49 corresponding to the theoretical presence of the sheet, is monitored by means of a flip-flop F7. Since the signal Q∇4 is applied to the input R of the flip-flop, the latter does not change its state if the signal PT coincides with the signal Q∇4. On the other hand, if these signals do not coincide F7 changes its state supplying a signal AR causing the immediate stoppage of the installation. It is also possible to take into account the direction of movement of the sheet by means of a signal DIR.

Figure 4:
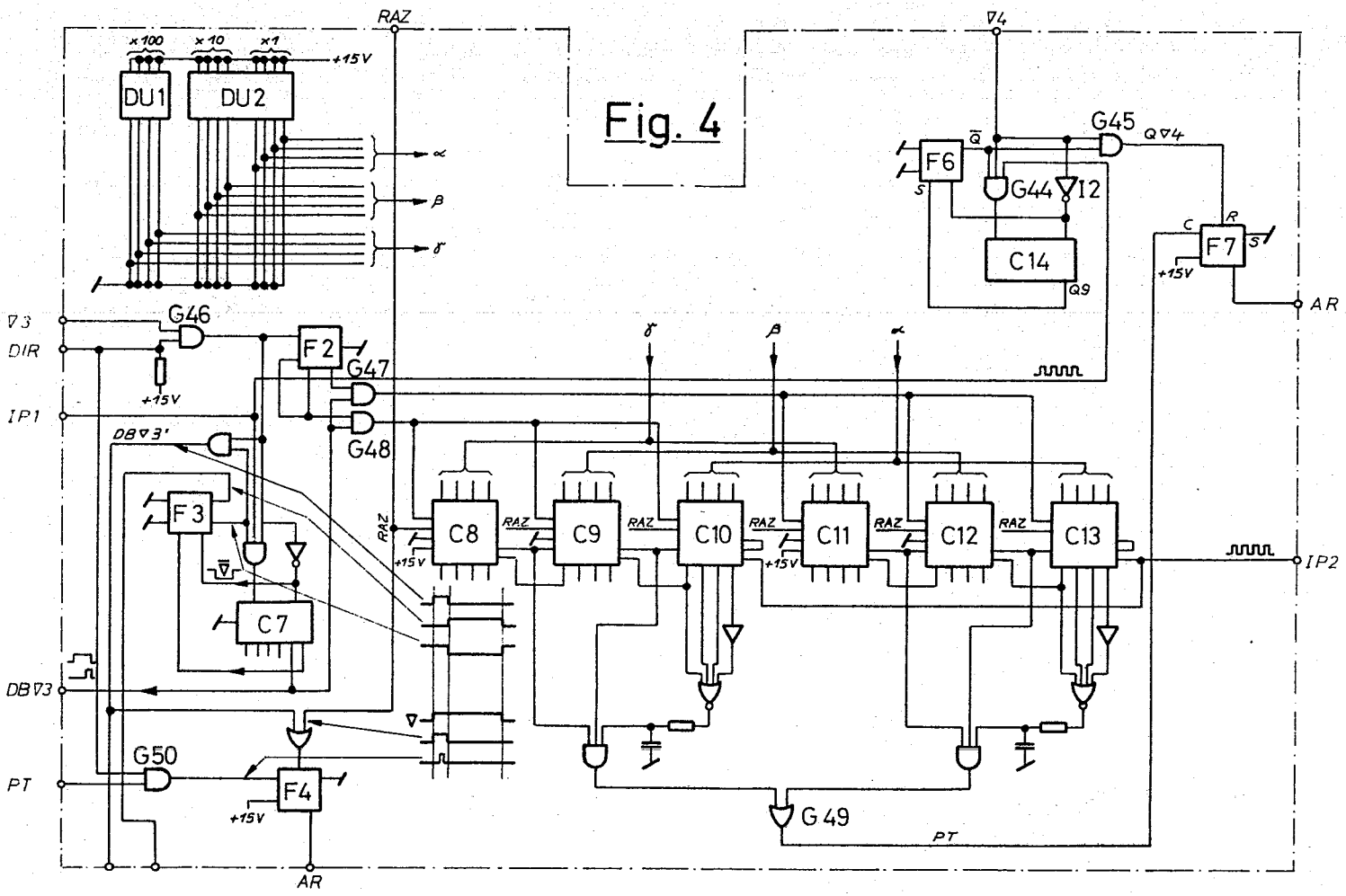
FIG. 4 shows the logic diagram of means for checking the passage of the sheets.

The circuit illustrated in FIG. 4 also comprises members forming part of the device for checking the presence of a sheet in front of the cell ∇3. The latter contains an arrangement F3/C7 identical to the arrangement F6/C14 for forming a pulse DB ∇3 corresponding to the beginning of the passage of a sheet in front of the cell ∇3. This signal is also applied through two AND gates G47 and G48 to two groups of counters C8 to C10 and respectively C11 and C13 for pre-selecting these counters. The same signal is also used for pre-selecting the counters/subtractors of the preceding circuit corresponding to the counters/subtractors C8 to C13. The signal "theoretical presence of the sheet" PT coming from the counters/subtractors of the preceding circuit is applied through an AND gate G50 to a flip-flop F4. If this signal coincides with DB∇3′ identical to the signal DB∇3, F4 does not change its state. In the case of noncoincidence F4 changes its state and a signal AR for stopping the installation is emitted.

What is claimed is:

1. An installation for inspecting and sorting printed sheets of paper comprising means for continuously transporting said sheets along a linear transfer path along which are disposed a plurality of devices for inspecting the sheets according to different criteria, and a switch at the end of the transfer path, controlled by the inspecting devices, for sorting the sheets into "accepted" sheets and "rejected" sheets, wherein the installation comprises associated with each inspection device, a device for detecting the passage of the sheets and a cyclic counter for assigning a consecutive number of a repeating series to each sheet detected, a reference memory in respect of each number assigned by the counters, shift registers between each of the inspection devices and the reference memories, a logic circuit between the counters and the reference memories for directing information from the inspection devices to the reference memory which corresponds to the number assigned to a sheet by the counters, and means for determining the position of the switch from the memorized signals.

2. An installation according to claim 1, wherein the means for determining the position of the switch from the memorised signals comprise a control delay device for introducing a delay which is proportional to the time taken for the sheet to travel between the last detector and the switch.

3. An installation according to claim 1, comprising means for monitoring the progress of the sheets, which means are constituted by up-down counters associated with each detecting device and which are initially charged on the arrival of a sheet detected by the detecting device and the contents of which are subsequently reduced by pulses the frequency of which is proportional to the theoretical velocity of the sheets for delivering at the end of the count-down a first signal corresponding to the theoretical presence of the sheet, whereby the subsequent detecting device delivers a second signal corresponding to the physical presence of the sheet when the sheet arrives before said subsequent detecting device, means being provided for selecting the duration of the second signal, and means for detecting the coincidence of the first and second signals.

* * * * *